US005533494A

United States Patent [19]

Sacco

[11] Patent Number: 5,533,494

[45] Date of Patent: Jul. 9, 1996

[54] ADJUSTABLE ARROW GRIP REST MOUNT

[76] Inventor: Edward Sacco, 2178 County Rte. 4, Central Square, N.Y. 13036

[21] Appl. No.: 258,947

[22] Filed: Jun. 13, 1994

[51] Int. Cl.[6] ..... F41B 5/22

[52] U.S. Cl. ..... 124/44.5; 124/24.1

[58] Field of Search ..... 124/24.1, 44.5, 124/86, 88

[56] References Cited

U.S. PATENT DOCUMENTS

| | | | |
|---|---|---|---|
| 4,858,589 | 8/1989 | Chang | 124/24.1 X |
| 5,022,378 | 6/1991 | Rhodehouse et al. | 124/44.5 |
| 5,095,884 | 3/1992 | Mertens | 124/44.5 |
| 5,103,797 | 4/1992 | Newbold | 124/44.5 |
| 5,140,972 | 8/1992 | Fisk | 124/44.5 |
| 5,146,908 | 9/1992 | Larson | 124/88 |
| 5,190,023 | 3/1993 | Sacco | 124/44.5 |
| 5,285,764 | 2/1994 | Mertens | 124/44.5 |
| 5,383,441 | 1/1995 | Lightcap | 124/44.5 |
| 5,400,763 | 3/1995 | Mazza | 124/44.5 |

*Primary Examiner*—Eric K. Nicholson
*Assistant Examiner*—John A. Ricci
*Attorney, Agent, or Firm*—Charles S. McGuire

[57] ABSTRACT

An arrow grip rest mount for attaching to the handle of an archery bow which is positionally adjustable in a lateral direction as well as being pivotal 360° about an axis extending transversely and laterally of the bow handle. The mount includes an L-shaped bracket piece with the arrow rest being mounted thereon. A first elongated plate is anchored to the blow handle slightly above the arrow ledge with the plate extending rearwardly of the handle. The bracket piece includes a second plate laterally extending therefrom which is slidable back and forth within an elongated aperture formed in the rear-most half of the first plate. A circular plate is selectively rotatable within a circular aperture formed in the front half of the plate with a bolt extending therethrough and securing the mount to the handle. The circular plate is pivotal about the bolt whereby the elongated plate may be moved in a circular path while maintaining the arrow rest in an upright, operable position.

10 Claims, 3 Drawing Sheets

ADJUSTABLE ARROW GRIP REST MOUNT

BACKGROUND OF THE INVENTION

The present invention relates to arrow grip rests for attaching adjacent the arrow ledge of an archery bow and, more particularly, to an arrow grip rest mount which also serves as an arrow over-draw and whose position relative to the arrow ledge handle is selectively adjustable in a lateral direction as well as a circular direction about an axis lying transversely and laterally to the handle.

Reference is made to U.S. Pat. No. 5,190,023 which issued to the present inventor on Mar. 2, 1993, the disclosure of which is incorporated herein by reference. The present invention improves upon the grip rest of the '023 patent by providing a mount which makes the grip rest positionally adjustable relative to the bow handle. The grip rest mount is movable along a circular path about an axis lying transversely lateral to the bow handle, in addition to being movable in a lateral direction thereby providing the archer with a grip rest which can be finely adjusted to make more accurate shots.

SUMMARY OF THE INVENTION

It is a principal object of the present invention to provide an arrow grip rest mount which is positionally adjustable relative to the bow handle.

It is a further object of the present invention to provide an arrow grip rest mount which enables the archer to move the rest to find his/her center shot with extreme accuracy.

It is another object to provide an arrow grip rest mount which is also an arrow overdraw, and which can be selectively moved in a circular direction while maintaining the grip rest in an upright, operable position.

It is still a further object of the present invention to provide an arrow grip rest mount which can be selectively adjusted in a lateral direction.

It is still another object of the present invention to provide an arrow grip rest mount which may be mounted to almost any bow handle on the market today.

It is yet a further object of the present invention to provide an arrow grip rest mount of the above type which is easy to adjust in either the lateral or circular directions.

Other objects will in part be obvious and in part appear hereinafter.

In accordance with the foregoing objects, the invention comprises an arrow grip rest mount for attaching to a bow handle adjacent the arrow ledge thereof. Although other rests may be used in combination with the present inventive mount, the preferred rest is a pair of arrow gripping members which are pivotally connected to a base plate substantially the same as shown and described in my prior U.S. Pat. No. 5,190,023. The rest of the '023 patent also has further improvements described below. The base plate of the '023 patent is mounted directly to the bow arrow ledge and was hence not positionally adjustable relative thereto. The present invention improves upon the '023 patent by providing an adjustable mounting bracket to which the base plate is mounted. An elongated, rectangular plate is also provided which is pivotally mounted at a first end thereof to the bow handle on the side of the handle opposite the arrow ledge.

The elongated, rectangular plate is mounted substantially perpendicularly to the bow handle and extends rearwardly toward the bow string. The adjustable mounting bracket to which the arrow gripping members and base plate attach includes a second plate extending laterally and perpendicularly from a side wall thereof. The plate extends through an elongated aperture formed adjacent the rear-most end of the elongated plate and is slidable inwardly and outwardly with respect thereto whereby the arrow rest mounting bracket may be moved laterally toward or away from the bow handle.

The elongated rectangular plate is pivotally connected to the bow handle as mentioned above. More particularly, the plate includes a circular aperture at its forward-most end into which a circular plate is rotatably and removably fitted. The circular plate includes a slotted aperture which extends radially from the center thereof. A bolt passes through the slot and aperture in the plate and is screwed into the bow handle. When the bolt is loosened, the circular plate may be pivoted about the bolt and simultaneously rotated within the circular aperture in the rectangular plate. Also, the radial position of the circular plate with respect to the bolt may be adjusted by moving the bolt along the slotted aperture in the circular plate. Since the circular plate is rotatable within the aperture in the elongated plate, the elongated plate (and thus the arrow rest and adjustable mounting bracket) may thus be pivoted a full 360° about an axis extending through the bolt while maintaining the elongated plate horizontal and the arrow grip rest in its upright, operable position. It may thus be realized that the position of the arrow grip rest may be moved both laterally and in a circular path as desired through movement of the adjustable bracket with respect to the elongated rectangular plate, and through movement of the elongated rectangular plate with respect to the mounting bolt, respectively.

DETAILED DESCRIPTION

Figure 2:
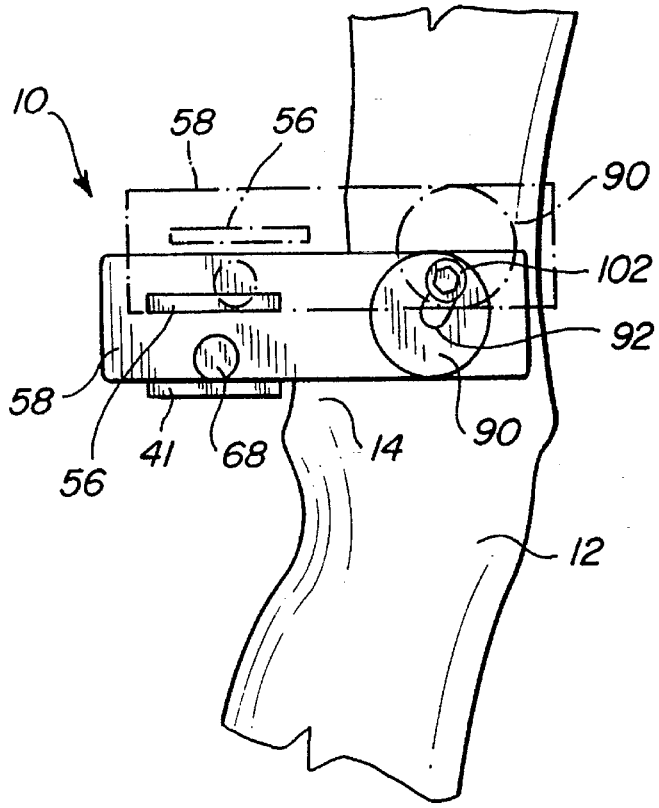
FIG. 2 is a side, elevational view of the arrow grip rest mount as viewed from the side opposite to that seen in FIG. 1, and with the mount seen in a position rotated clockwise (dashed lines) about the mounting bolt.
Figure 1:
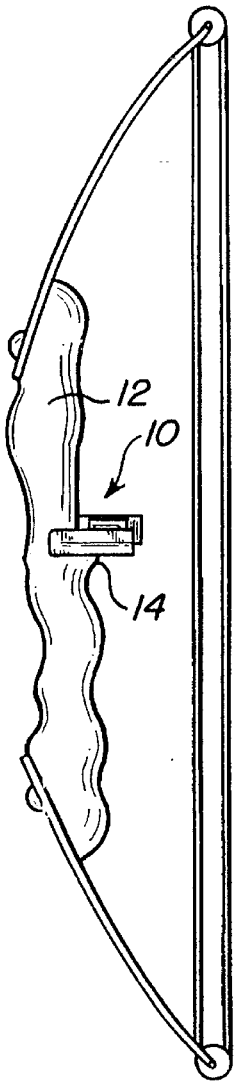
FIG. 1 is a side, elevational view of a compound bow with the arrow grip rest mount attached thereto.

Referring now to the drawings, there is seen in the Figures the arrow grip rest mount 10 for mounting to a conventional bow handle 12 adjacent the arrow ledge portion 14 thereof. The arrow grip rest 11 (seen best in FIG. 4) includes a pair of elongated arrow gripping members 16 and 18 having longitudinally concave inner surfaces 20 and 22, respectively, for engaging opposite sides of the shaft of an arrow seen in dashed lines in FIG. 3. Gripping members 16 and 18 include downwardly extending shaft portions 24 and 26, respectively, which are pivotally attached at the ends thereof opposite gripping members 16 and 18 to a rectangular base plate 28. A pair of legs 30 and 32 attach to and extend downwardly from the junctures of the gripping members and shaft portions with the free ends of the legs extending through laterally spaced apertures 31 and 33 formed in the base plate 28. A pair of springs 34 and 36 are disposed about legs 30 and 32, respectively, which act to bias gripping members 16 and 18 upwardly away from base plate 28. As an arrow is fired through gripping members 16 and 18, any downward forces greater than the biasing force of the springs 34 and 36 push legs 30 and 32 through apertures 31 and 33 in base plate 28 so as to not interfere with the normal trajectory of the arrow.

Base plate 28 is mounted in covering relation to the top surface 38 of the horizontally disposed half 40 of L-shaped bracket piece 42 by bolts 37 and 39 which extend through respective apertures 41 and 43 formed in base plate 28, and through aligned apertures formed in bracket piece half 40 and shield piece 48 (only one such aperture 45 is shown). It is noted that forward aperture 43 is laterally elongated whereby bolt 39 may be loosened to pivot base plate 28 about rear bolt 37 whereby the direction of fire of an arrow may be laterally adjusted thorugh an arc of approximately 15°. The bottom surface 44 of bracket half 40 is mounted in covering relation to the base portion 46 of shield piece 48 which further includes a side wall 50 which integrally extends at an obtuse angle "a" from base portion 46. Alternatively, it is envisioned that shield piece 48 and bracket piece 42 may be formed as one integral piece. Wall 50 is approximately twice as long as base portion 46 and includes a second longitudinal bend forming an obtuse angle "b". Shield piece 48 protects the hand of the archer which grips the handle against inadvertent contact with the arrow during firing.

Bracket piece 42 is further provided with a square plate 52 which is perpendicularly attached (e.g., by welding) along a side edge 54 thereof to the outside wall of bracket half 41 adjacent and parallel to the top edge 47 thereof. Plate 52 slides into an elongated, rectangular slot 56 longitudinally formed in an elongated, rectangular plate 58. When plate 58 is secured to bow handle 12 in the manner to be described below, plate 58 lies in a fixed, lateral position with respect thereto. Square plate 52 of bracket 42 is slidable within slot 56 and, as such, the interconnected assembly comprising arrow grip rest 11, bracket piece 42, and shield 48 may be moved laterally with respect to rectangular plate 58 and thus also to bow handle 12 to which plate 58 attaches.

Figure 6:
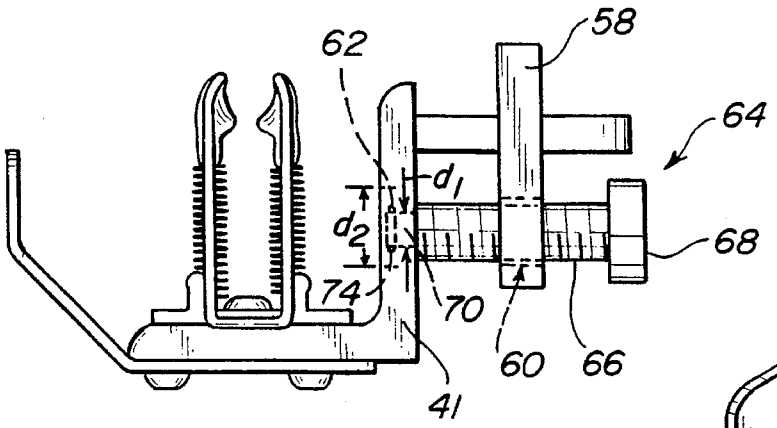
FIG. 6 is a rear, elevational view of the arrow grip rest and adjustable arrow grip rest mount.

As seen in FIG. 6, plate 58 and bracket half 41 are provided with aligned circular apertures 60 and 62 below slot 56 and square plate 52, respectively. Aperture 60 is threaded while aperture 62 is not. Furthermore, aperture 62 is divided into two diameters $d_1$ and $d_2$ at the outer and inner surfaces of bracket half 41, respectively, with diameter $d_1$ being smaller than diameter $d_2$. A bolt 64 having a threaded shaft 66, a head portion 68, and a terminal end portion 70 is provided which passes through apertures 60 and 62 allowing the lateral distance between bracket half 41 and rectangular plate 58 to be selectively adjusted. Specifically, aperture 60 in plate 58 is threaded to engage with the threads on bolt shaft 66. The terminal end portion 70 of bolt 64 is of smaller diameter than shaft 66 and includes an annular groove 72 formed therein. Diameter $d_1$ of aperture 62 is slightly larger than bolt end portion 70 and, therefore, end portion 70 passes through aperture 62 to the half of aperture 62 having diameter $d_2$ with bolt shaft 66 abutting bracket half 41. End portion 70 is freely rotatable within aperture 62 and a retaining clip 74 is attached to end portion 70 in groove 72 and inside diameter $d_2$ to rotatably secure bolt 64 to bracket half 41. Since bolt shaft 66 is threadedly engaged with aperture 60 in plate 58 (and since plate 58 is fixed to bow handle 12 as mentioned above), as bolt 64 is turned in either direction, bracket piece 41 (including all interconnected parts) moves either toward or away from rectangular plate 58. With an arrow shaft positioned between gripping members 16 and 18, the arrow shaft may thus be positioned either closer to or further away from bow handle 12 as desired by simply turning bolt 64.

To secure square plate 52 within slot 56, two pairs of set screws 76, 77 and 78, 79 extend into respective pairs of threaded bores 80, 81 and 82, 83 formed in opposite side edges 84 and 86 of plate 58 all the way through to slot 56. Screws 76–79 are preferably of the allen type and may be selectively tightened and loosened to frictionally engage and release, respectively, the opposite planar surfaces of square plate 52.

Figure 4:
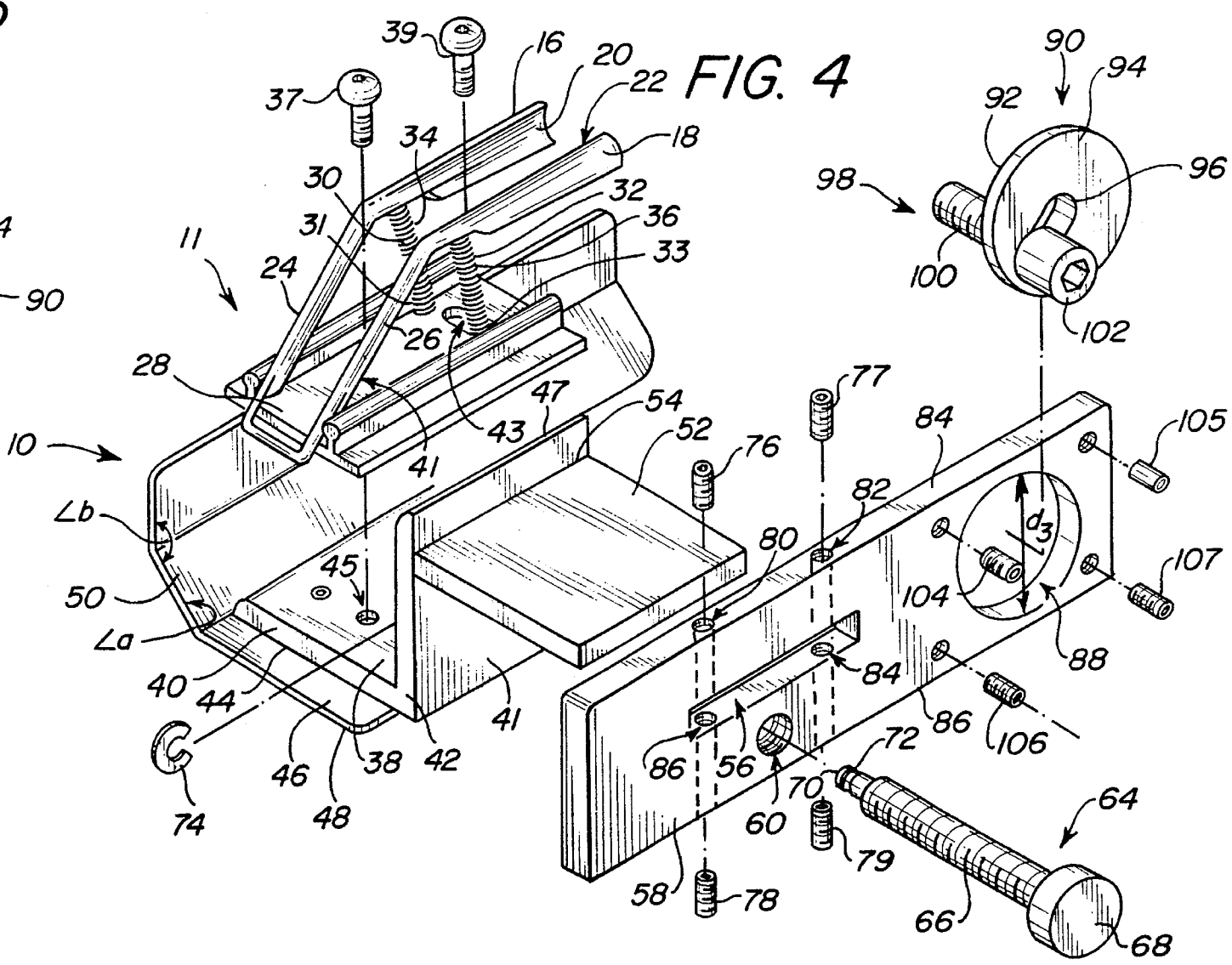
FIG. 4 is an exploded, perspective view of the arrow grip rest and adjustable arrow grip rest mount.
Figure 5:
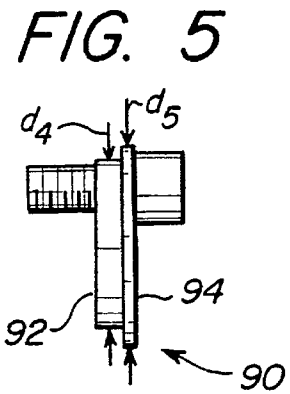
FIG. 5 is a side, elevational view of the circular plate and bolt.
Figure 7:
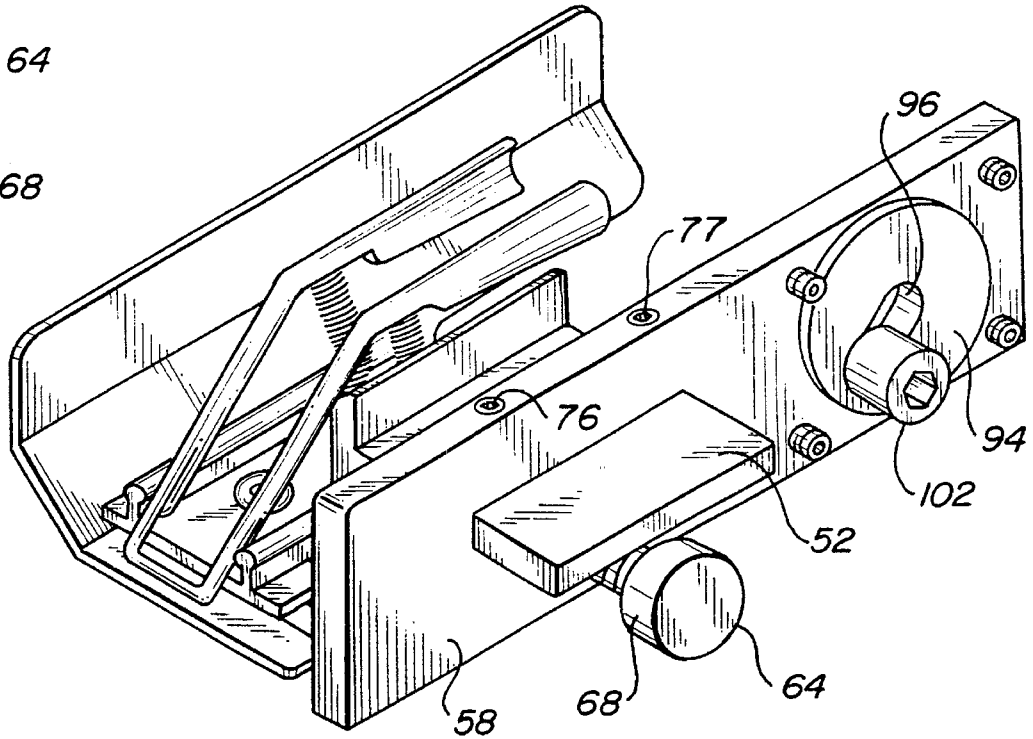
FIG. 7 is a perspective view of FIG. 6.

Attention is now turned to the manner in which rectangular plate 58 is attached to bow handle 12. As seen in FIG. 4, rectangular plate 58 has a large circular aperture 88 having a diameter $d_3$ positioned in longitudinally spaced relationship to slot 56. A circular plate 90 is provided which is divided into a base portion 92 and a head portion 94 having diameters $d_4$ and $d_5$, respectively, with diameter $d_4$ being smaller than diameter $d_5$ and slightly smaller than diameter $d_3$ such that plate base portion 92 fits and is freely rotatable within aperture 88 while plate head portion 94 lies in abutting contact with plate 58 as seen in FIG. 7.

Figure 3:
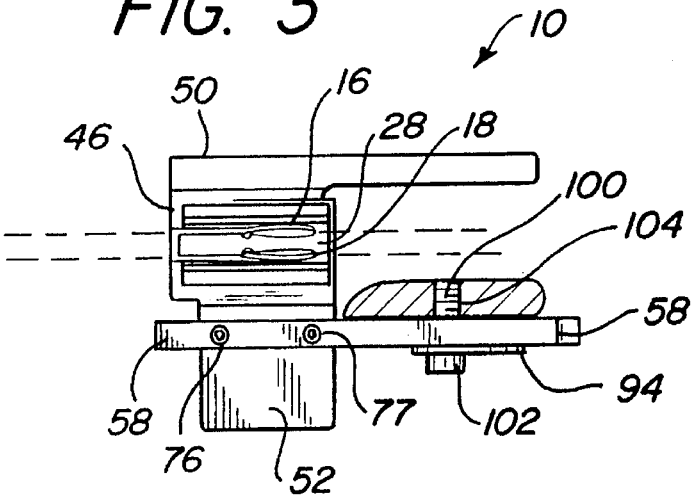
FIG. 3 is a top plan view of the arrow grip rest and arrow grip rest mount attached to the bow handle (in section) and an arrow shaft shown in dashed lines extending between the arrow gripping members.

Plate 90 is further provided with a slotted aperture 96 which extends radially outwardly from the center of the plate. With plate base portion 92 positioned within aperture 88 as described above, a second bolt 98 having a threaded shaft 100 and allen-type head portion 102 is passed through slotted aperture 96 and screwed into a hole 104 formed in bow handle 12 (FIG. 3). As seen in FIGS. 2 and 3, hole 104 is formed laterally through bow handle 12 slightly above the arrow ledge 14 with rectangular plate 58 secured thereto such that it extends rearwardly toward the bow strings in substantially perpendicular relationship to bow handle 12. In this position, bracket piece 41 including gripping members 16 and 18 lie rearwardly of handle 12 to provide an arrow over-draw as discussed in the Background section.

Besides being able to adjust the lateral position of gripping members 16 and 18 with respect to handle 12 as described above, the entire arrow grip rest mount may be pivoted a full 360° about bolt 98 by loosening bolt 98 and set screws 104–107 and rotating circular plate 90 within circular aperture 88. This is accomplished while maintaining rectangular plate 58 perpendicular to handle 12, with arrow rest 10 and gripping members 16 and 18 in their upright, operable position. Also, the circumference of the 360° circle through which plate 58 may pivot may be varied between a maximum and minimum by moving bolt shaft 100 from one end of the slotted aperture 96 to the other. By fine tuning each of these positional adjustments, the archer can find his/her center shot with extreme accuracy and ease.

What is claimed is:

1. Apparatus for adjusting the position of an arrow rest relative to the handle of an archery bow having an integral arrow ledge and a bow string attached to said handle, said apparatus comprising:

a) means for supporting said arrow rest in an upright, operable position adjacent said bow handle;

b) means for attaching said arrow rest supporting means to said bow handle said attaching means comprising a first elongated, planar plate having first and second, longitudinally spaced portions with said first portion being attached to said bow handle and said second portion being attached to said supporting means, said first positional adjusting means comprising a second planar plate fixedly attached to and laterally extending from said support means, and a first elongated slot formed in said second portion of said first elongated, planar plate, and wherein said second planar plate is inserted and slidable back and forth therein.

2. The invention according to claim 1 wherein said first positional adjusting means further comprises a first bolt having a threaded shaft, head portion and opposite terminal end portion, said first bolt removably extending through first and second, aligned apertures formed in said first elongated, planar plate and said support means, respectively, and wherein said first aperture is threaded and said first bolt shaft is threadedly engaged within said first aperture, and said first bolt terminal end is rotatably secured in said second aperture.

3. The invention according to claim 1 wherein said support means comprises a bracket piece having first and second planar walls disposed at right angles to each other, and wherein said arrow rest is mounted on one of said first and second planar walls and said second planar plate is perpendicularly attached to the other of said first and second planar walls on the surface thereof facing away from said one of said first and second planar walls, and wherein said second aperture is formed in said other of said first and second planar walls.

4. The invention according to claim 3 and further comprising an elongated shield plate attached to said one of said first and second planar walls, said shield plate extending upwardly from an edge of said one of said first and second planar walls located opposite said other of said first and second planar walls.

5. The invention according to claim 1 and further comprising means releasably securing said second planar plate at a selected position within said first elongated slot.

6. The invention according to claim 5 wherein said releasable securing means comprises at least one set screw extending within a threaded bore formed in said first plate and extending to said first slot whereby said set screw may be alternately brought into and out of frictional engagement with said second planar plate when inserted in said first slot.

7. Apparatus for adjusting the position of an arrow rest relative to the handle of an archery bow having an integral arrow ledge and a bow string attached to said handle, said apparatus comprising:

a) means for supporting said arrow rest in an upright, operable position adjacent said bow handle;

b) means for attaching said arrow rest supporting means to said bow handle; and c) positional adjusting means operable to move said attaching means along a circular path about an axis lying transversely and laterally to said bow handle while maintaining said arrow rest in said upright, operable position.

8. The invention according to claim 7 wherein said attaching means comprises a first elongated, planar plate having first and second, longitudinally spaced portions with said first portion being attached to said bow handle and said second portion being attached to said support means, and wherein positional adjusting means comprises:

a) a circular aperture having a first diameter formed in said first elongated, planar plate;

b) a circular plate having first and second, integral halves lying in spaced, parallel planes and having second and third diameters, respectively, said second diameter being slightly smaller than said first diameter of said circular aperture and said third diameter being larger than both of said first and second diameters, said first half of said circular plate being inserted and freely rotatable within said circular aperture with portions of said second half of said circular plate lying in abutting contact with portions of said first plate surrounding said circular aperture, said circular plate further including a second elongated aperture radially extending from the center of said circular plate; and c) a second bolt removably extending through said second elongated aperture and into said bow handle thereby securing said first elongated, planar plate and said circular plate together upon said bow handle, whereby said second bolt may be selectively and alternately loosened and tightened such that said circular plate may simultaneously pivot about said second bolt and rotate within said circular aperture with said second bolt located along a selected position within said second elongated aperture thereby allowing movement of said first elongated, planar plate about said circular path while maintaining said arrow rest in said upright, operable position.

9. Apparatus for adjusting the position of an arrow rest relative to the handle of an archery bow having an integral arrow ledge and a bow string attached to said handle, said apparatus comprising:

a) means for supporting said arrow rest in an upright, operable position adjacent said bow handle;

b) means for attaching said arrow rest supporting means to said bow handle;

c) first positional adjusting means for interconnecting said attaching means and said support means in a position rearwardly of said arrow ledge toward said bow string, said first adjusting means being operable to vary the distance between said attaching means and said support means; and d) second positional adjusting means operable to move said attaching means along a circular path about an axis lying transversely and laterally to said bow handle while maintaining said arrow rest in said upright, operable position.

10. The invention according to claim 9 wherein said attaching means comprises a first elongated, planar plate having first and second, longitudinally spaced portions with said first portion being attached to said bow handle and said second portion being attached to said support means, and wherein said second positional adjusting means comprises:

a) a circular aperture having a first diameter formed in said first elongated, planar plate;

b) a circular plate having first and second, integral halves lying in spaced, parallel planes and having second and third diameters, respectively, said second diameter being slightly smaller than said first diameter of said circular aperture and said third diameter being larger than both of said first and second diameters, said first half of said circular plate being inserted and freely rotatable within said circular aperture with portions of said second half of said circular plate lying in abutting contact with portions of said first plate surrounding said circular aperture, said circular plate further including a second elongated aperture radially extending from the center of said circular plate; and c) a second bolt removably extending through said second elongated aperture and into said bow handle thereby securing said first elongated, planar plate and said circular plate together upon said bow handle, whereby said second bolt may be selectively and alternately loosened and tightened such that said circular plate may simultaneously pivot about said second bolt and rotate within said circular aperture with said second bolt located along a selected position within said second elongated aperture thereby allowing movement of said first elongated, planar plate about said circular path while maintaining said arrow rest in said upright, operable position.

* * * * *